US006215034B1

(12) United States Patent
Oomori et al.

(10) Patent No.: US 6,215,034 B1
(45) Date of Patent: Apr. 10, 2001

(54) BASE FUEL OIL FOR DIESEL FUEL OIL AND DIESEL FUEL OIL COMPOSITION COMPRISING THE SAME

(75) Inventors: Noriaki Oomori, Saitama; Kazuyuki Murakami, Fukuyama; Kazuyoshi Namiyama, Saitama, all of (JP)

(73) Assignee: Tonen Corporation, Saitama (JP)

( * ) Notice: Subject to any disclaimer, the term of this patent is extended or adjusted under 35 U.S.C. 154(b) by 0 days.

(21) Appl. No.: 09/459,032

(22) Filed: Dec. 10, 1999

(30) Foreign Application Priority Data

Dec. 25, 1998 (JP) ..... 10-369428

(51) Int. Cl.[7] ..... C10L 1/08
(52) U.S. Cl. ..... 585/14; 44/300; 208/15
(58) Field of Search ..... 585/14; 44/300; 208/15

(56) References Cited

U.S. PATENT DOCUMENTS

| | | | | |
|---|---|---|---|---|
| 4,753,661 | | 6/1988 | Nelson et al. | 44/53 |
| 5,730,762 | | 3/1998 | Murakami et al. | 44/329 |
| 5,792,339 | * | 8/1998 | Russell | 585/14 |
| 5,863,303 | | 1/1999 | Yamamoto et al. | 44/398 |
| 5,976,201 | * | 11/1999 | Barry et al. | 585/14 |
| 6,004,361 | * | 12/1999 | Barry et al. | 585/14 |
| 6,039,771 | * | 3/2000 | Selvidge | 585/14 |
| 6,087,544 | * | 7/2000 | Wittenbrink et al. | 585/14 |
| 6,150,575 | * | 8/1998 | Angevine et al. | 585/14 |

FOREIGN PATENT DOCUMENTS

| | | | |
|---|---|---|---|
| 0807676 | 11/1997 | (EP) | C10L/1/22 |
| 0960930 | 12/1999 | (EP) | C10L/1/16 |
| 0967263 | 12/1999 | (EP) | C10L/1/14 |
| 08225789 | 9/1903 | (JP) | C10L/1/04 |
| 08291292 | 11/1905 | (JP) | C10L/1/22 |
| 11241078 | 9/1907 | (JP) | C10L/1/16 |
| 08157839 | 6/1918 | (JP) | C10L/1/04 |
| 07331261 | 12/1919 | (JP) | C10L/1/18 |
| 09194856 | 7/1929 | (JP) | C10L/1/08 |
| 09194859 | 7/1929 | (JP) | C10L/1/18 |
| WO97/14768 | 4/1997 | (WO) | C10L/1/02 |
| WO98/05740 | 2/1998 | (WO) | C10L/1/08 |

* cited by examiner

*Primary Examiner*—Jacqueline V. Howard
(74) *Attorney, Agent, or Firm*—Joseph J. Allocca

(57) ABSTRACT

This invention provides a base fuel oil, having improved response to lubricity additives, for diesel fuel oil characterized by (1) sulfur content of 0.03 wt % or less, (2) nitrogen content of 35 wt. ppm or less, (3) density of 0.835 g/cm$^3$ or less and (4) solubility parameter of 7.00 to 8.10, and also provides a diesel fuel oil composition comprising the above base fuel oil incorporated with a lubricity additive.

13 Claims, No Drawings

BASE FUEL OIL FOR DIESEL FUEL OIL AND DIESEL FUEL OIL COMPOSITION COMPRISING THE SAME

FIELD OF THE INVENTION

This invention relates to a novel diesel fuel oil composition, more particularly a base fuel oil for diesel fuel oil to exhibit excellent lubricity improving effect, which is incorporated with a lubricity improver.

DESCRIPTION OF THE RELATED ART

Diesel engines are widely used for various purposes, e.g., for driving automobiles, ships and construction machines, and are still spreading further. As a result, fuel oil for diesel engines is increasingly in demand, and becoming heavier to satisfy the increased demands, because straight-run diesel fuel oil is distilled deeper and/or blended with heavier fractions. It is anticipated that the above trends are accompanied by increased NOx and particulate matter emissions in exhaust gases to further aggravate air pollution.

A variety of techniques have been proposed from wide angles to abate air pollutants, e.g., NOx and particulate matter, present in exhaust gases from diesel engines, such as improved combustion chamber shapes, installation of various devices (e.g., exhaust gas recycle (EGR) system, exhaust gas cleaning-up catalytic converter system and particulate matter trapping system), and improvement of diesel fuel and lubricant oils. An EGR system, which is considered to be one of the effective means to abate the pollutant emissions, recycles part of exhaust gases from the diesel engine back to the combustion chamber as part of the combustion air. However, it may cause several problems when sulfate ions and particulate matter are present in the exhaust gases, such as deteriorated durability and reliability of the engine, deteriorated lubricant oil, increased emissions of particulate matter and decreased power output. These problems will be further aggravated when it is installed in a direct-injection engine, which is required to operate at a high load. The sulfate ions are derived from sulfur compounds present in diesel fuel oil, and "low-sulfur diesel fuel oil" containing sulfur at 0.05 wt % or less has become a social need.

Sulfur in a diesel fuel oil can be reduced by refining, in particular catalytic hydrotreating, of the base stocks. This, however, is accompanied by decreased lubricity of diesel fuel oil itself, and will damage the injection device of the engine. It is known that wear of the injection pump notably increases as sulfur content decreases from 0.2 wt %.

Attempts have been made to improve diesel fuel oil lubricity by the aid of lubricity improver to solve the above problems, but failed to produce satisfactory results.

DESCRIPTION OF THE INVENTION

The present invention relates to a base fuel oil for diesel fuel oil having properties necessary for a lubricity improver to exhibit its lubricity-improving effect, and a diesel fuel oil comprising the above base fuel oil incorporated with a lubricity improver.

The present invention is based on the discovery that the lubricity improver, that lubricity of diesel fuel oil is improved as a lubricity improver in the base fuel oil is quickly adsorbed on the metal surface and that the base fuel oil must have low affinity for the lubricity improver not to hinder adsorption of the improver on the metal surface.

The present invention provides a base fuel oil for diesel fuel oil of improved response to lubricity additives characterized by (1) sulfur content of 0.03 wt % or less, (2) nitrogen content of 35 wt. ppm or less, (3) density of 0.835 g/cm$^3$ or less and (4) solubility parameter of 7.00 to 8.10.

The present invention also provides a diesel fuel oil composition comprising the above base fuel oil which is incorporated with a lubricity improver.

The present invention, relating to the above base fuel oil for diesel fuel oil and diesel fuel oil composition, includes the following preferred embodiments:

(1) the above mentioned base fuel oil for diesel fuel oil composition having a density of 0.830 g/cm$^3$ or less, (2) the base fuel oil for diesel fuel oil composition of the above (1) having a solubility parameter of 7.50 to 8.05, and (3) the above mentioned diesel fuel oil composition comprising the base fuel oil of one of the above (1) and (2) which is incorporated with a lubricity improver.

The present invention is described below in further detail. The base fuel oil of the present invention for diesel fuel oil has a sulfur content, nitrogen content, density and solubility parameter in specific ranges. The diesel fuel oil composition of the present invention comprises the above base fuel oil which is incorporated with a lubricity improver.

Base Fuel Oil for Diesel Fuel Oil

The base fuel oil of the present invention for diesel fuel oil has a sulfur content of 0.03 wt % or less, preferably 0.025 wt % or less, and nitrogen content of 35 wt. ppm or less, preferably 25 wt. ppm or less. When its sulfur content exceeds 0.03 wt % or nitrogen content exceeds 35 wt. ppm, the base fuel oil will have sufficient affinity for the lubricity improver with a polar group to prevent it from being adsorbed on the metal surface. As a result, the lubricity improver incorporated in the base fuel oil will no longer fully exhibit its intended lubricity improving effect.

The base fuel oil of the present invention for diesel fuel oil also has a density of 0.835 g/cm$^3$ or less, preferably 0.830 g/cm$^3$ or less. When its density exceeds 0.835 g/cm$^3$, difference in density between the base fuel oil and lubricity improver will be sufficiently small to prevent the latter from being adsorbed on the metal surface. As a result, the lubricity improver incorporated in the base fuel oil will no longer fully exhibit its intended lubricity improving effect.

The base fuel oil of the present invention for diesel fuel oil also has a solubility parameter of 7.00 to 8.10, preferably 7.50 to 8.05. When its solubility parameter is below 7.00, the base fuel oil will be insufficiently compatible with the lubricity improver, possibly causing phase separation. When its solubility parameter exceeds 8.10, difference in solubility parameter between the base fuel oil and lubricity improver will be sufficiently small to excessively increase compatibility between them, possibly preventing the lubricity improver incorporated in the base fuel oil from fully exhibiting its intended lubricity improving effect.

Solubility parameter is a measure of solubility in a nonelectrolytic solvent, and a solute will be more compatible with a solvent when difference between them in solubility parameter decreases. It is given by surface tensions of solvent and solute:

$$\delta=4.19P^{0.43}$$

$$P=\sigma V^{-1/3}$$

wherein, $\delta$ stands for solubility parameter, P for internal pressure (dyn/cm$^2$), $\sigma$ for surface tension (dyn/cm) and V for molar volume (cm$^3$).

A lubricity improver can fully exhibit its intended effect when the base fuel oil in which it is incorporated has the following properties: (1) sulfur content of 0.03 wt % or less, (2) nitrogen content of 35 wt. ppm or less, (3) density of 0.835 g/cm$^3$ or less and (4) solubility parameter of 7.00 to 8.10.

The above properties can be adjusted by various methods, e.g., blending of petroleum fractions from different crude sources, solvent extraction, hydrotreatment and adequate combination thereof. These fractions are used individually or in combination for the base fuel oil of the present invention.

Diesel Fuel Oil Composition

The diesel fuel oil composition of the present invention comprises the above base fuel oil which is incorporated with a lubricity improver and other types of additives.

The lubricity improver useful for the present invention is not limited, and can be selected from the known ones. These include fatty acids, e.g., stearic, linolic and oleic acid, and esters, e.g., those of the above fatty acids and poly-alcohols, represented by the ester of linolic acid and glycerin. The preferable one is an ester. A lubricity improver dosage below 0.002 wt % may not satisfactorily improve lubricity, and above 0.1 wt % is not economical, because lubricity will not be improved as much as increased dosage. The preferable lubricity improver dosage is 0.005 to 0.05 wt %. The above lubricity improvers may be used individually or in combination.

The diesel fuel oil composition of the present invention may be incorporated, as required, with other known additives for fuel oil, so long as its performance is not damaged. These additives include flow improver, pour point depressant, cetane improver, antioxidant, metal deactivator, detergent, corrosion inhibitor, de-icer, bactericide, combustion promoter, antistatic agent, and coloring agent. A general dosage of the additive is 0.1 to 0.5 wt % in the case of pour point depressant, although not limited to this level. One or more of these additives may be used for the present invention, as required.

The flow improvers useful for the present invention include polyethylene glycol ester-based compounds, ethylene-vinyl acetate-based copolymers, ethylene-alkylacrylate-based copolymers, chlorinated polyethylene, polyalkyl acrylate, alkenyl succinamide-based compounds and so on.

The diesel fuel oil composition of the present invention may be also incorporated, as required, with one or more types of oxygenated compounds so long as its performance is not damaged. These compounds include aliphatic alcohols, e.g., methanol, ethanol, isopropanol, n-butanol, isobutanol, tert-butanol, amyl alcohol, isoamyl alcohol, n-octanol, 2-ethyl hexanol, n-heptyl alcohol, tridecyl alcohol, cyclohexanol and methyl cyclohexanol; ethers, e.g., methyl tert-butyl ether and ethyl tert-butyl ether; dialkyl phthalates, e.g., diethyl phthalate, dipropyl phthalate and dibutyl phthalate; glycol-ether compounds, e.g., ethylene glycol monoisobutyl ether, diethylene glycol mono-n-butyl ether, diethylene glycol monoisobutyl ether, diethylene glycol dimethyl ether, tri-ethylene glycol mono-n-butyl ether, triethylene glycol dimethyl ether, propylene glycol monomethyl ether acetate and dipropylene glycol mono-n-butyl ether; hydroxyl amine compounds; and diketones, e.g., acetyl acetone. A general dosage of the oxygenated compound, if used, is 1 to 15 wt %, although not limited to this level.

The present invention is described in more detail by Examples, which by no means limit the present invention. The following base stocks and lubricity improvers were used for Examples and Comparative Examples. The method to determine solubility parameter was also described.

(1) Base Stock

The base stocks used for Examples and Comparative Examples are described in Table 1.

Base stock A is a straight-run diesel fuel fraction from low-sulfur Minas crude, hydrodesulfurized to adjust its properties.

Base stock B is a 50-50 mixture of straight-run diesel fuel fractions from low-sulfur Minas crude and a Middle Eastern crude, also hydro-desulfurized.

Base stock C is a 50-50 mixture of Base stock B and a straight-run kerosene fraction from a Middle Eastern crude.

Base stock D is a straight-run diesel fuel fraction from a Middle Eastern crude.

Base stock E is a straight-run diesel fuel fraction from a low-sulfur Minas crude.

Base stock F is an 80-20 mixture of Base stock D and a cracked diesel fuel fraction.

Base stock G is an 80-20 mixture of Base stock E and a cracked diesel fuel fraction.

TABLE 1

| | Base Stocks | | | | | | |
|---|---|---|---|---|---|---|---|
| | A | B | C | D | E | F | G |
| Distillation (° C.) | | | | | | | |
| Initial boiling point | 158 | 158 | 161 | 194 | 194 | 193 | 193 |
| 10% | 186 | 187 | 184 | 231 | 237 | 224 | 226 |
| 50% | 249 | 250 | 217 | 277 | 278 | 275 | 276 |
| 90% | 315 | 316 | 277 | 324 | 328 | 321 | 322 |
| End point | 343 | 344 | 326 | 351 | 350 | 343 | 346 |
| Sulfur content, wt % | 0.022 | 0.014 | 0.024 | 0.045 | 0.03 | 0.04 | 0.03 |
| Nitrogen content, wt. ppm | 23 | 11 | 17 | 40 | 45 | 30 | 35 |
| Density, g/cm$^3$ | 0.829 | 0.826 | 0.813 | 0.836 | 0.831 | 0.840 | 0.839 |
| Solubility parameter | 8.04 | 8.02 | 7.82 | 8.11 | 8.07 | 8.09 | 8.06 |

(2) Lubricity Improver

A lubricity improver with an ester-based compound as the active component (PDN655, produced by Exxon Chemical) was used.

(3) Determination of Solubility Parameter

Solubility parameter was determined by the following equations, as described earlier:

$$\delta=4.19P^{0.43}$$

$$P=\sigma V^{-1/3}$$

wherein, δ stands for solubility parameter, P for internal pressure (dyn/cm$^2$), σ for surface tension (dyn/cm) and V for molar volume (cm$^3$).

Surface tension σ of the base stock was determined by a surface tension meter (Kyowa Kaimen Kagaku, FACE automatic surface tension meter PD-Z). Molar volume V of the base stock was determined from its molecular weight M and density ρ (g/cm$^3$) by the relationship V=M/ρ.

EXAMPLES AND COMPARATIVE EXAMPLES

Each diesel fuel oil was prepared by incorporating the base fuel oil with 100 wt. ppm of the lubricity improver (PDN655), and lubricity-tested to measure wear scar diameter. The results are given in Table 2. The method to determine lubricity is also described.

TABLE 2

| | EXAMPLES | | | COMPARATIVE EXAMPLES | | | |
|---|---|---|---|---|---|---|---|
| | 1 | 2 | 3 | 1 | 2 | 3 | 4 |
| Fuel oil | | | | | | | |
| Composition (wt %) | | | | | | | |
| Base Stock A | 99.99 | | | | | | |
| Base Stock B | | 99.99 | | | | | |
| Base Stock C | | | 99.99 | | | | |
| Base Stock D | | | | 99.99 | | | |
| Base Stock E | | | | | 99.99 | | |
| Base Stock F | | | | | | 99.99 | |
| Base Stock G | | | | | | | 99.99 |
| Lubricity improver | 0.01 | 0.01 | 0.01 | 0.01 | 0.01 | 0.01 | 0.01 |
| Properties | | | | | | | |
| Sulfur content, wt % | 0.022 | 0.014 | 0.024 | 0.045 | 0.03 | 0.04 | 0.03 |
| Nitrogen content, wt. ppm | 23 | 11 | 17 | 40 | 45 | 30 | 35 |
| Density, g/cm$^3$ | 0.829 | 0.826 | 0.813 | 0.836 | 0.831 | 0.840 | 0.839 |
| Solubility parameter | 8.04 | 8.02 | 7.82 | 8.11 | 8.07 | 8.09 | 8.06 |
| Lubricity of diesel fuel oil | | | | | | | |
| Improvement of wear scar diameter, * μm | 200 | 210 | 260 | 100 | 120 | 70 | 80 |

*Wear scar diameter with the base fuel oil minus that with the diesel fuel oil.

Measurement of Lubricity

Lubricity was assessed by resistance of diesel fuel oil to wear. Resistance to wear was measured as per JPI-5S-50-98 (gas oil/lubricant oil testing method). Wear scar diameter (μm) was determined using a high frequency reciprocating rig (HFRR, produced by PCS) under the conditions shown in Table 3. Wear scar diameter increases as lubricity of diesel fuel oil decreases. Wear scar diameter is an average of major scar diameter and minor scar diameter, (major scar diameter+minor scar diameter)/2. Lubricity is represented by improvement of wear scar diameter, wear scar diameter with the base fuel oil minus that with the diesel fuel oil.

TABLE 3

| | |
|---|---|
| Liquid quantity | 2 ± 0.20 ml |
| Stroke | 1 ± 0.03 mm |
| Frequency | 50 ± 1 Hz |
| Liquid temperature | 40 ± 2° C., or 60 ± 2° C. |
| Load | 200 ± 1 gf |
| Testing time | 75 ± 0.1 minute |
| Liquid surface area | 6 ± 1 cm$^2$ |

As shown in Table 2, the diesel fuel oils prepared by Examples 1 to 3 are excellent in lubricity, showing larger improvements of wear scar diameter than those prepared by Comparative Examples, which show very poor improvements, because at least one of their sulfur content, nitrogen content, density and solubility parameter is not in the specified range.

As described above in detail, the diesel fuel oil composition of the present invention shows excellent lubricity, because its base fuel oil has properties of (1) sulfur content of 0.03 wt % or less, (2) nitrogen content of 35 wt. ppm or less, (3) density of 0.835 g/cm$^3$ or less and (4) solubility parameter of 7.00 to 8.10, and is incorporated with a lubricity improver.

What is claimed is:

1. A base fuel oil for diesel fuel oil characterized by (1) sulfur content of 0.03 wt % or less, (2) nitrogen content of 35 wt. ppm or less, (3) density of 0.835 g/cm$^3$ or less and (4) solubility parameter of 7.00 to 8.10, said fuel having an improved response to lubricity additives.

2. The base fuel oil of claim 1 further incorporated with additives comprising at least one lubricity improver to produce a diesel fuel oil.

3. The base fuel oil of claim 1 or 2 wherein the sulfur content is 0.025 wt % or less.

4. The base fuel oil of claim 1 or 2 wherein the nitrogen content is 25 wt. ppm or less.

5. The base fuel oil of claim 1 or 2 wherein the density is 0.830 g/cm$^3$ or less.

6. The base fuel oil of claim 3 wherein the density is 0.830 g/cm$^3$ or less.

7. The base fuel oil of claim 4 wherein the density is 0.830 g/cm$^3$ or less.

8. The base fuel oil of claim 1 or 2 wherein the solubility parameter is between 7.50 to 8.05.

9. The base fuel oil of claim 3 wherein the solubility parameter is between 7.50 to 8.05.

10. The base fuel oil of claim 4 wherein the solubility parameter is between 7.50 to 8.05.

11. The base fuel oil of claim 5 wherein the solubility parameter is between 7.50 to 8.05.

12. The base fuel oil of claim 6 wherein the solubility parameter is between 7.50 to 8.05.

13. The base fuel oil of claim 7 wherein the solubility parameter is between 7.50 to 8.05.

* * * * *